United States Patent [19]

Hillenbrand et al.

[11] Patent Number: 4,634,935

[45] Date of Patent: Jan. 6, 1987

[54] GAS-DISCHARGE DISPLAY DEVICE WITH A POST-ACCELERATION SECTION

[75] Inventors: Bernhard Hillenbrand, Uttenreuth; Wilhelm Huber, Goldach; Burkhard Littwin, Hohenschäftlarn; Karl Schuster, Marloffstein-Adlitz, all of Fed. Rep. of Germany

[73] Assignee: Siemens Aktiengesellschaft, Berlin and Munich, Fed. Rep. of Germany

[21] Appl. No.: 640,008

[22] Filed: Aug. 10, 1984

[30] Foreign Application Priority Data

Aug. 11, 1983 [DE] Fed. Rep. of Germany ..... 3329106

[51] Int. Cl.[4] ..... H01J 17/49

[52] U.S. Cl. ..... 315/169.4; 313/493; 313/485; 313/582; 252/520

[58] Field of Search ..... 313/485, 491, 582, 586, 313/422, 495, 493; 315/169.4; 252/520

[56] References Cited

U.S. PATENT DOCUMENTS

| | | | |
|---|---|---|---|
| 3,914,635 | 10/1975 | Bode et al. | 313/586 |
| 4,297,613 | 10/1981 | Aboelfotoh | 313/584 |
| 4,313,854 | 1/1982 | Sunahara et al. | 252/520 |
| 4,329,626 | 5/1982 | Hillenbrand et al. | 315/169.4 |
| 4,362,967 | 12/1982 | Littwin et al. | 313/485 |

FOREIGN PATENT DOCUMENTS 3207685 9/1983 Fed. Rep. of Germany .

OTHER PUBLICATIONS

Ordean Oen et al, Computer Studies of the Reflection of Light Ions from Solids, 1976, 647–653.

*Primary Examiner*—David K. Moore
*Assistant Examiner*—M. Razavi
*Attorney, Agent, or Firm*—Herbert L. Lerner; Laurence A. Greenberg

[57] ABSTRACT

Gas discharge display device having a vacuum-tight envelope with a front and back plate. A control unit divides the interior of the envelope filled with gas into a back and front space. The back space has at least one plasma cathode and at least one plasma anode. The front plate carries a cathodoluminescent layer and a layer electrode. The control unit contains at least one electrode plane extending parallel to the wall plates, with at least one conductor. In operation a gas discharge burns between the plasma electrodes. The distance between the post-acceleration anode and cathode is small such that no gas discharge is ignited in the post-acceleration space. The post-acceleration cathode is coated with an implantation protection layer of a high-melting metal to maintain the operating voltage constant under continuous load.

17 Claims, 3 Drawing Figures

GAS-DISCHARGE DISPLAY DEVICE WITH A POST-ACCELERATION SECTION

BACKGROUND OF THE INVENTION

1. Field of the Invention

The invention relates to a gas-discharge display device constructed of:

(a) a vacuum-tight envelope with two mutually parallel wall plates (front plate, back plate) which are disposed one behind the other in the direction of view, is filled with a gas;

(b) a control unit which is located in the envelope and is regularly perforated, divides the interior of the envelope into a back and a front space (gas discharge space and post-acceleration space, respectively);

(c) at least one cathode (plasma cathode) and at least one anode (plasma anode) is in the gas discharge space;

(d) the front plate carries on its backside a cathodoluminescent layer and a layer electrode (post-acceleration anode);

(e) the control unit contains at least one electrode plane extending parallel to the wall plates, with at least one conductor;

(f) the post-acceleration cathode is coated with an implantation protection layer of a high-melting metal.

2. Description of the Prior Art

A gas discharge display device (plasma panel) is disclosed in U.S. application Ser. No. 470,702 filed Feb. 28, 1983, based on German Application No. P 3207685.

In the flat picture screen of the mentioned application, electrons of a gas discharge are sent through selectively opened holes of a control unit into a space free of plasma in which they take on energies of several kV and finally generate light dots on a luminescent screen.

With the concept of separate electron generation and acceleration, it is possible to display colored video pictures with an acceptable quality. However, maintaining all the important operating parameters stable over extended operating periods has not been successful to date. Thus, a particular parameter is the operating voltage of the plasma which increases regularly and if the picture screen is switched to bright continuously, can assume twice the value after a few hundred operating hours. Such a voltage drift poses enormous requirements with respect to the driving circuit and the cathode and should be avoided at all costs.

German Published Non-Prosecuted Application No. DE-OS 29 29 270 (U.S. Pat. No. 4,329,626) discusses filling the display device with $H_2$, using an aluminum cathode and keeping the cathode surface under a thin oxide layer during the gas discharge. Practice has shown, however, that these measures are not sufficient especially in cases in which the display device is continuously operating for an extended period of time. There is no substantial improvement even if other gases or cover layers are used, as for instance an Ne-Ar mixture and an $MgO/Al_2O_3$—Ta/Mo skin (IBM Technical Disclosure Bulletin 25 (1983), Page 658).

SUMMARY OF THE INVENTION

An object of the invention is to provide a plasma panel of the type mentioned at the outset in which the operating voltage remains constant, particularly under continuous load.

With the foregoing and other objects in view, there is provided in accordance with the invention a gas discharge display device comprising:

(a) a gas-filled space gas-tightly closed on one side by a front plate and on a side opposite thereto by a back plate parallel to the front plate, the plates disposed one behind the other;

(b) a control unit dividing the gas-filled space into a back space as a gas discharge space and a front space as a post-acceleration space, the control unit having regularly spaced perforations;

(c) at least one plasma cathode and at least one plasma anode in the gas discharge space wherein a gas discharge burns between the plasma electrodes in operation;

(d) the front plate carrying on its backside a cathodoluminescent layer and a layer electrode as a post-acceleration anode;

(e) the control unit having at least one electrode plane extending parallel to the wall plates with at least one conductor as a post-acceleration cathode;

(f) means for applying a high voltage larger than 1 kV between the post-acceleration anode and the post-acceleration cathode of the foremost electrode plane, and with a small distance between both post-acceleration electrodes to suppress igniting the gas discharge in the post-acceleration space; the combination therewith of (g) a coating on the post-acceleration cathode of a protective implantation layer of a high-melting metal from the subgroups A of the fourth to eighth group and of the fifth to sixth period of the periodic system of the elements.

The term "high melting" as used herein, means that the (average) melting temperature is above 1730° C.

Other features which are considered as characteristic for the invention are set forth in the appended claims.

Although the invention is illustrated and described herein as embodied in a gas-discharge display device with a post-acceleration section, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in conjunction with the accompanying drawings, in which.

DETAILED DESCRIPTION OF THE INVENTION

The proposed solution to the problem of maintaining the voltage constant starts out from the observation that the main cause for the troublesome rise of the voltage is a gradual dropping of the gas pressure. In the post-accelerating space, ions are generated which impinge on the post-accelerating cathode and are captured there in part. This implantation effect which depends on the nature of the gas and the electrode and is particularly pronounced if helium and aluminum are used, can lead to a gas consumption of up to 40%.

The protective layer provided in accordance with the invention consists of materials which have a relatively high reflection factor for ions of the types and energies of interest here. While the ions impinging on the protective layer give off the major part of their kinetic energy, they are, however, scattered back again in most cases. Life tests have shown that in this manner, the rise of the operating voltage can be slowed down without difficulty by a factor 3, and the voltage itself can be stabilized at a distinctly lower level.

The fact that metals with a high nuclear charge number reflect light-weight ions strongly, is known per se; see in this connection Nuclear Instruments and Methods, Volume 132 (1976), Page 647. This paper, however, is in a foreign area and has a different objective; the point there is to obtain, within the scope of a controlled nuclear fusion, mainly information regarding the energy and density distribution of the reflected ions.

The protective layer provided in accordance with the invention is normally between $10^{-3}$ μm and $10^{-1}$ μm and preferably between $5 \cdot 10^{-3}$ μm and $4 \cdot 10^{-2}$ μm in thickness. It is best if the layer metal is an element from the subgroup A of the fourth to seventh group and the sixth period of the periodic system of the elements. The preferred metal is a member selected from the group consisting of Zr, Nb, Mo, Ta, W and Re. Incidentally, the protective layer need not consist completely of the metal. As has been found, acceptable results are also obtained if the layer surface is hardened by a chemical process, for instance by oxidation.

The invention will now be explained in greater detail with the aid of an embodiment example in conjunction with the attached drawing.

Figure 1:
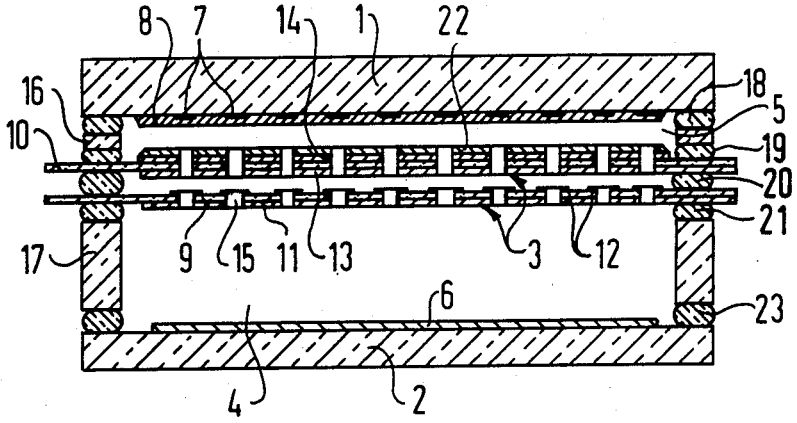
FIG. 1 illustrates in section view a gas discharge display device according to the invention, with an implantation protection layer as the post-acceleration cathode.

The panel shown in FIG. 1, which is intended for a data display, contains a vacuum tight envelope which is a space filled with gas, with a front panel 1, a back panel 2 and a control unit 3. All three parts, namely the front panel, the back panel and the control unit extend in planes parallel to each other. The control unit 3 divides the interior of the envelope into a gas discharge space 4 and a post-acceleration space 5.

The back plate 2 is provided on its front side, i.e. the side facing gas discharge space 4 with several mutually parallel conductor strips (plasma cathode 6). The front panel 1 carries on its backside, i.e. the side facing the post acceleration spacer, a cathodoluminescent layer 7 and a continuous layer electrode (post-acceleration anode 8). The control unit 3 has two support plates 9 and 10 which are coded on both sides with electrodes. The back plate 9, so designated because it is back of plate 10, carries on its backside (the side facing back panel 2) line conductors 11 and on its front side (the side facing front panel 1), column conductors 12. The conductors of both conductor families are perpendicular to each other, can be addressed individually and together form the control matrix proper. The front plate 10, so designated because it is forward of plate 9, is provided on the backside with tetrode conductors 13 parallel to the line conductors 11, and on the front side, with a Ni-pentode (post-acceleration cathode 14) which is applied over the entire surface and is about 2 μm thick. The entire control unit has a through opening 15 in the region of each matrix element and is spaced from the front and back panel by a respective spacer frame 16 and 17. All parts are joined to each other vacuum-tight via glass solder seams 18, 19, 20, 21 and 23.

As can be seen from FIG. 1, the post-acceleration cathode 14 is covered with a further metal layer (implantation protection layer 22). This layer which has a thickness of between $10^{-2}$ μm and $2 \cdot 10^{-2}$ μm consists of tungsten and is applied by means of a customary vacuum technique.

Figure 2:
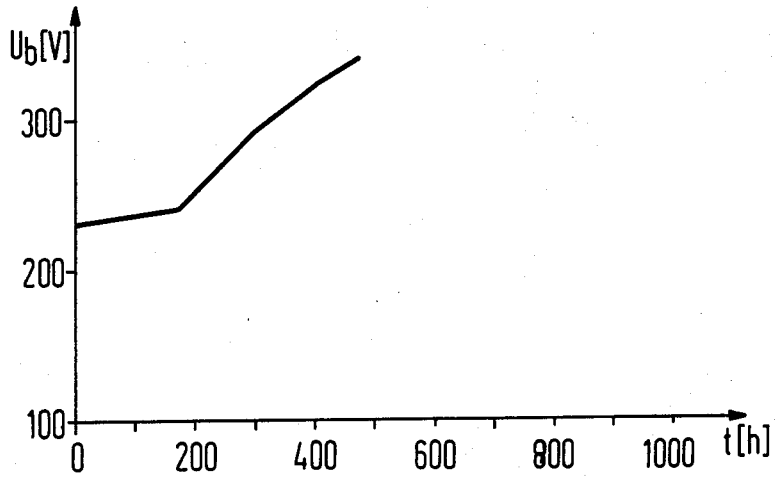
FIG. 2 shows the operating voltage as a function of the operating time if an unprotected post-acceleration cathode is used.
Figure 3:
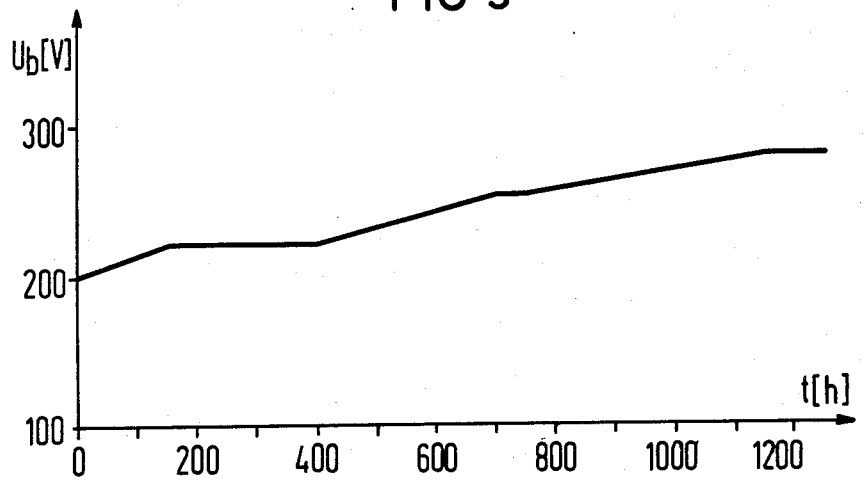
FIG. 3 shows the change in operating voltage with time, and in accordance with the invention with an implantation protection layer on the post-acceleration cathode.

To demonstrate the stabilizing effect of the protective implantation layer, the operation voltage $U_b$, measured in volts, is plotted as a function of the operating time t, measured in hours and specifically with an Ni-post-acceleration cathode 2 μm thick which, in one case, was unprotected (FIG. 2) and the other time had a Ta-layer $4 \cdot 10^{-2}$ μm thick (FIG. 3). In both cases, the display was addressed dynamically. A comparison of the two curves shows that the protective layer delays the rise in voltage considerably, limits it to lower values and in addition, even lowers the firing voltage.

In the operation of the display, a wedge-shaped gas discharge always burns between one of the plasma cathodes and one of the line conductors. This plasma is stepped by way of line conductors, and during the "on" time of a line conductors, all column conductors receive the corresponding line information. According to this information, the electrodes are admitted through the control holes, then enter as point-shaped electron beams into the post-acceleration space and are taken, accelerated to 4 kV, onto the phosphorous layer. Further operating and design details can be seen from the specifications mentioned at the outset or from the article published in "Elektronik", Volume 14 (1982), Page 79.

The invention is not limited to the embodiment shown. Thus, it is immaterial how the gas discharge is generated and which form it is given. Therefore, a static transverse plasma may also be used. Apart from that, the implantation protection layer may be an alloy on the basis of one of the claimed materials and optionally, its surface could be refined in some other way, for instance by conversion into a carbide, boride or silicide. It is furthermore not necessary that the protective layer adheres particularly firmly to its substrate. To the contrary, with a relatively loose adhesion, the ions which have penetrated into the layer only to a small part and diffused toward the base metallization can return through a relatively porous boundary layer back into the gas space. To this extent, a multi-layer protection layer may be desirable. Other surfaces which are endangered by implantation may be coated with the protective layer.

We claim:

1. Gas discharge display device comprising (a) a gas-filled, vacuum-tight envelope with a front plate and a back plate which is parallel to the latter, and (b) a control unit which is located in the interior of said envelope, and provided with regular perforations, and which divides the interior of the envelope into a gas discharge space, and a post-acceleration space;

(c) at least one cathode, and at least one anode in the gas-discharge space, between which the gas discharge is ignited in the operating state;

(d) a cathodo-luminescent layer attached to the backside of the front plate which is covered by a post-acceleration anode;

(e) a post-acceleration cathode whose distance from the post-acceleration anode is so small that no gas discharge is ignited in the post acceleration space in the operating state, the combination therewith wherein the post-acceleration cathode is coated with an implantation protection layer of a high-melting metal selected from the subgroups A of the fourth to eighth group and of the fifth to sixth period of the periodic system of elements.

2. Device according to claim 1, wherein the high-melting metal is selected from the subgroups A of the fourth to seventh group and the sixth period.

3. Device according to claim 1, wherein the high-melting metal is selected from the group consisting of Zr, Nb, Mo, Ta, W and Re.

4. Device according to claim 1, wherein the protective implantation layer is oxidized on its surface.

5. Device according to claim 2, wherein the protective implantation layer is oxidized on its surface.

6. Device according to claim 3, wherein the protective implantation layer is oxidized on its surface.

7. Device according to claim 1, wherein the protective implantation layer is carburized on its surface.

8. Device according to claim 2, wherein the protective implantation layer is carburized on its surface.

9. Device according to claim 3, wherein the protective implantation layer is carburized on its surface.

10. Device according to claim 1, wherein the protective implantation layer has a thickness between $10^{-3}$ $\mu$m and $10^{-1}$ $\mu$m.

11. Device according to claim 1, wherein the protective implantation layer has a thickness between $5 \cdot 10^{-3}$ $\mu$m and $4 \cdot 10^{-2}$ $\mu$m.

12. Device according to claim 2, wherein the protective implantation layer has a thickness between $10^{-3}$ $\mu$m and $10^{-1}$ $\mu$m.

13. Device according to claim 3, wherein the protective implantation layer has a thickness between $10^{-3}$ $\mu$m and $10^{-1}$ $\mu$m.

14. Device according to claim 4, wherein the protective implantation layer has a thickness between $10^{-3}$ $\mu$m and $10^{-1}$ $\mu$m.

15. Device according to claim 7, wherein the protective implantation layer has a thickness between $10^{-3}$ $\mu$m and $10^{-1}$ $\mu$m.

16. Device according to claim 1, wherein the post-acceleration cathode consists of nickel or aluminum and has a thickness of between 0.5 $\mu$m and 10 $\mu$m.

17. Device according to claim 1, wherein the gas filling consists at least partially of He.

* * * * *